US005544557A

United States Patent [19]

Wierschke

[11] Patent Number: 5,544,557

[45] Date of Patent: Aug. 13, 1996

[54] METHOD AND APPARATUS FOR CUTTING SUPERPOSED WEBS

[75] Inventor: Larry D. Wierschke, Green Bay, Wis.

[73] Assignee: Paper Converting Machine Company, Green Bay, Wis.

[21] Appl. No.: 372,645

[22] Filed: Jan. 13, 1995

[51] Int. Cl.[6] ..... B26D 1/58

[52] U.S. Cl. ..... 83/37; 83/330; 83/955

[58] Field of Search ..... 83/321, 322, 323, 83/325, 350, 436, 439, 444, 449, 459, 13, 37, 330, 329, 955

[56] References Cited

U.S. PATENT DOCUMENTS

| | | | |
|---|---|---|---|
| 2,093,323 | 9/1937 | Lamoreaux | 83/325 X |
| 2,336,957 | 12/1943 | Pierce | 83/323 X |
| 3,288,009 | 11/1966 | Bradley . | |
| 3,483,780 | 12/1969 | Hudson | 83/325 X |
| 3,512,437 | 5/1970 | Enneper et al. | 83/325 X |
| 4,041,813 | 8/1977 | Spencer . | |
| 4,052,048 | 10/1977 | Shirasaka . | |
| 4,693,262 | 9/1987 | Goldbach et al. | 313/84.3 |
| 4,966,542 | 10/1990 | Kobayashi | 425/307 X |
| 5,031,498 | 7/1991 | Koppel | 83/436 X |
| 5,289,747 | 3/1994 | Wunderlich . | |

FOREIGN PATENT DOCUMENTS

| | | |
|---|---|---|
| 507750 | 10/1992 | European Pat. Off. . |
| 555190 | 8/1993 | European Pat. Off. . |

*Primary Examiner*—Rinaldi I. Rada
*Assistant Examiner*—Boyer Ashley
*Attorney, Agent, or Firm*—Tilton, Fallon, Lungmus & Chestnut

[57] ABSTRACT

A method of cutting an elongated multi-ply flat surfaced ribbon of web material which includes advancing the ribbon along a linear path while rotating a pair of cantilever-mounted drums on opposite sides of the path to flank the ribbon flat surfaces, the drums each having a plurality of axially extending slots in the periphery thereof. A saw blade is adjacent the path and orbits through the path so as to have the blade orbit intersect the drum slot orbits to transversely cut the ribbon while the saw is advancing parallel to the linear path.

22 Claims, 7 Drawing Sheets

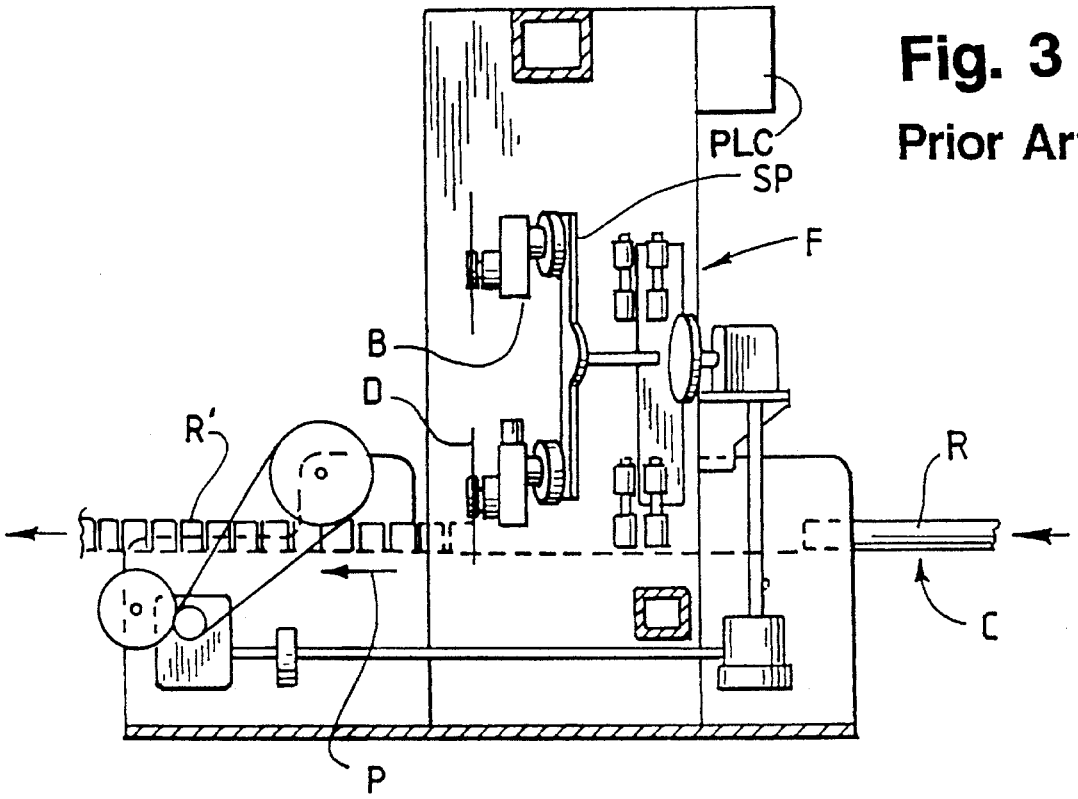
Fig. 3
Prior Art
Fig. 4
Prior Art
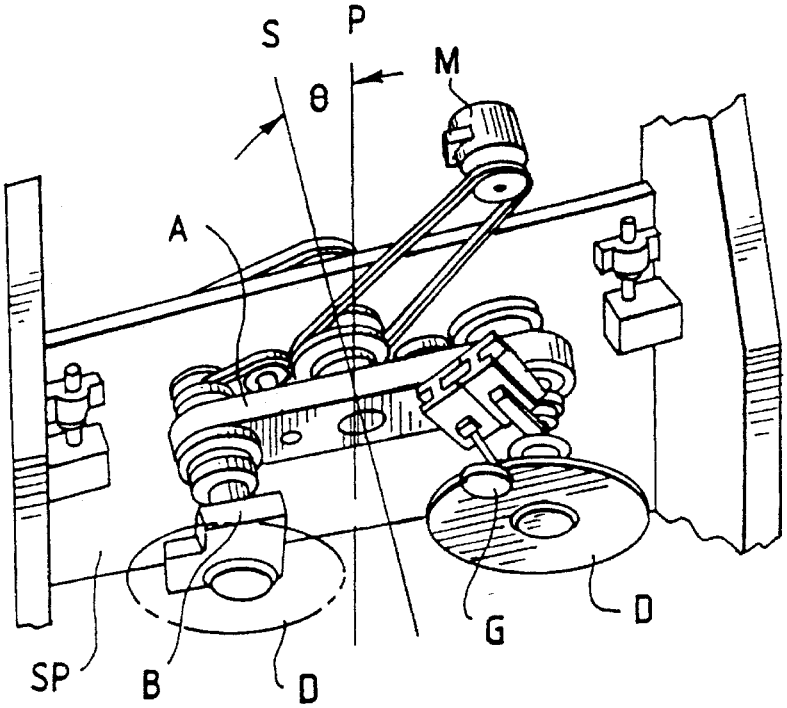

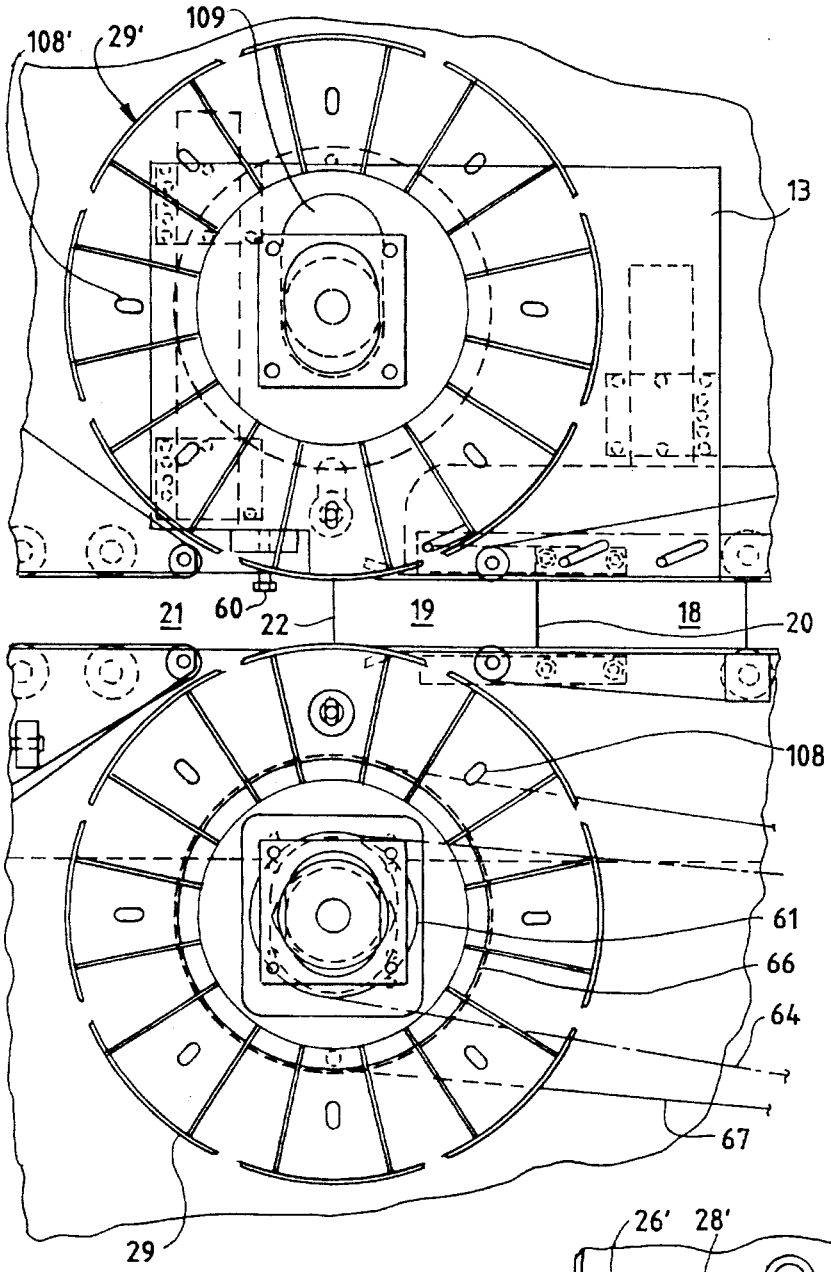
Fig. 6
Fig. 7
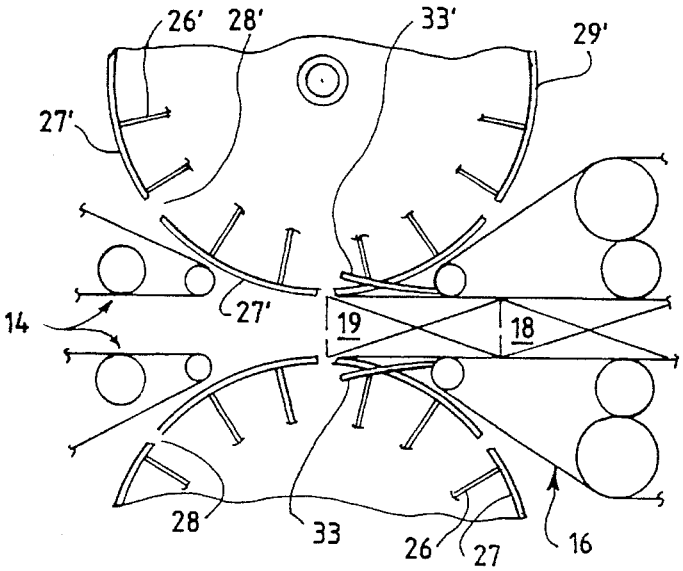

Fa
88'
85
84
87
86
78'
77'
17'
12
17'
17
89
83
75
78
88
79
81
16
77
76
82
74
73
70
65
72
64
68
67
69

METHOD AND APPARATUS FOR CUTTING SUPERPOSED WEBS

This invention relates to a method and apparatus for cutting superposed webs and, more particularly, to webs arranged in an elongated, multi-ply, flat-surfaced ribbon such as is commonly used as facial tissue.

BACKGROUND AND SUMMARY OF INVENTION

The product cut by the invention is usually continuous and, many times, interfolded as provided in co-owned U.S. Pat. No. 4,052,048. Exemplary of the apparatus used to cut the ribbon into stacks is co-owned U.S. Pat. No. 3,288,009. More generally, over the last 30 years the primary method of conveying a ribbon through a saw has been with the use of flight bars mounted on a chain both above and below the ribbon. At times on slow machines only a bottom flighted conveyor was used and the top of the ribbon was held down with plates spaced on each side of the saw blades and traveling with the reciprocating motion saws.

A commercial machine embodying the above principle incorporated flights that were spaced to generate a repeating pattern of openings for the blade to pass through, equal to the cutoff length that was desired. When other cutoffs were required the bars were manually respaced or the entire chain assembly replaced. This system has worked well and has no known speed limitations other than the saw.

While this system has worked well for machines whose cutoff length is dedicated to a single size for long periods of time, production needs now increasingly vary and the cutoff length requirements can often change on a daily basis. The current flight conveyor requires a minimum of 4 hours to replace chains in order to achieve a new repeat and this is generally unacceptable.

The object of the instant invention is to retain the benefits of flighted cutting while obtaining quick length adjustability.

SUMMARY OF INVENTION

The invention for cutting an elongated, multi-ply, flat-surfaced ribbon of web material employs the following general steps (and means therefor): advancing the ribbon along a linear path, rotating a pair of cantilever-mounted drums on opposite sides of the path so as to flank the flat surfaces of the ribbon, the drums having a plurality of equally circumferentially spaced, axially-extending slots in the periphery thereof. A saw adjacent the path is orbited with the saw blade orbit intersecting the slot orbit to perform transverse cutting of the ribbon. Here the term "ribbon" is used in a broad sense—covering ribbons per se and also "bolts" of material as they may come out of a rotary interfolder.

The cantilever mounting of the drums avoids any interference with the travel of the saw blade. The drums rotate at a speed such that one slot of each drum contacts the ribbon for each passing of a blade. Upstream of the drums are a set of opposed feed belts which perform the usual functions of removing excess air from the ribbon; creasing any folds in the ribbon; controlling the transportation of the ribbon from further upstream equipment; and feeding the proper amount of ribbon into the drums for each passing of the blade.

As the infeed belts deliver a fixed amount "X" of ribbon per cut, the surface of the rotating drums also travels a distance at least equal to or greater than this fixed amount "X". This insures proper feeding of the ribbon through the drum contact areas without causing any retardation of the outer plies.

The maximum amount of travel that the drums can exceed "X" per cut is limited by the width of the slot in the drum, the relation of the drum diameter to the blade orbit and the desired clearance to be maintained between the edge of each slot and the face of the blade. Because the forward speed of the blade should closely match that of the ribbon, when the desired cutoff length changes, the saw head that controls the forward motion of the blades should also be adjusted to match the forward speed of the ribbon if a square cut is needed. In saws that orbit at an angle to the direction of ribbon advance, the forward motion is adjusted by changing the "skew" angle. Exemplary of such saws are U.S. Pat. Nos. 4,041,813 and 5,289,747; and U.S. application Ser. No. 08/223,543 filed Apr. 6, 1994 or EPO published application 555,190. However, the invention may be used to advantage in other orbiting saws such as that of EPO published application 507,750.

In any event, if the cutoff length equals the pitch length of the slots, the blade stays perfectly centered in the slots. But as the cutoff length decreases (or increases) and the forward velocity of the blades decreases (or increases), the RPM of the drum must remain the same (one slot per cut), and this means that the blade no longer remains centered in the slot. However, this gives any drum an infinite range of cutoffs—until the acceptable, i.e., predetermined, slot-to-blade clearance is lost.

The commercial flighted chain conveyor which has been used since the start of facial saws gives a fixed length cutoff plus 0.0 mm (0.0 inches) to minus up to about 3 mm. (0.125 inches) depending on how much tension is employed. In the invention, and even without varying the preset tension, the range is plus 0.0 inches to minus up to about 38 mm. (1.50 inches)—or 12 times greater. And this is also possible with pushbutton length change at the ribbon conveyor while still retaining the same type of ribbon support at cutting that the flighted bar system provided. In essence, this new system is an adjustable flighted system, viz., the ability to change cutoff length quickly and infinitely within a given range. The "plus" side is zero because if more, then the ribbon would be traveling faster than the drum—and would be retarded or scuffed.

The advantages of the inventive method and apparatus are equally great when acceptable slot to blade clearance is no longer present with given drums. In such a case, the range of cutoff can quickly be changed by replacing the slotted drums. This takes under 15 minutes as compared with four hours for the flight chain design—a factor of 16 times. Further advantages include the ability to fine tune the cut length without adding additional tension to the ribbon, and the elimination of the use of a chain which also presents a maintenance and lubrication problem.

BRIEF DESCRIPTION OF DRAWING

The invention is described in conjunction with an illustrative embodiment in the accompanying drawing, in which—

FIG. 3 is a schematic side elevational view of a continuous motion saw according to the prior art;

FIG. 4 is a fragmentary perspective view of a continuous motion saw according to the prior art;

FIG. 6 is an enlargement of the central portion of FIG. 1;

FIG. 7 is a schematic elevational view of the central portion of FIG. 6;

DETAILED DESCRIPTION

Figure 1:
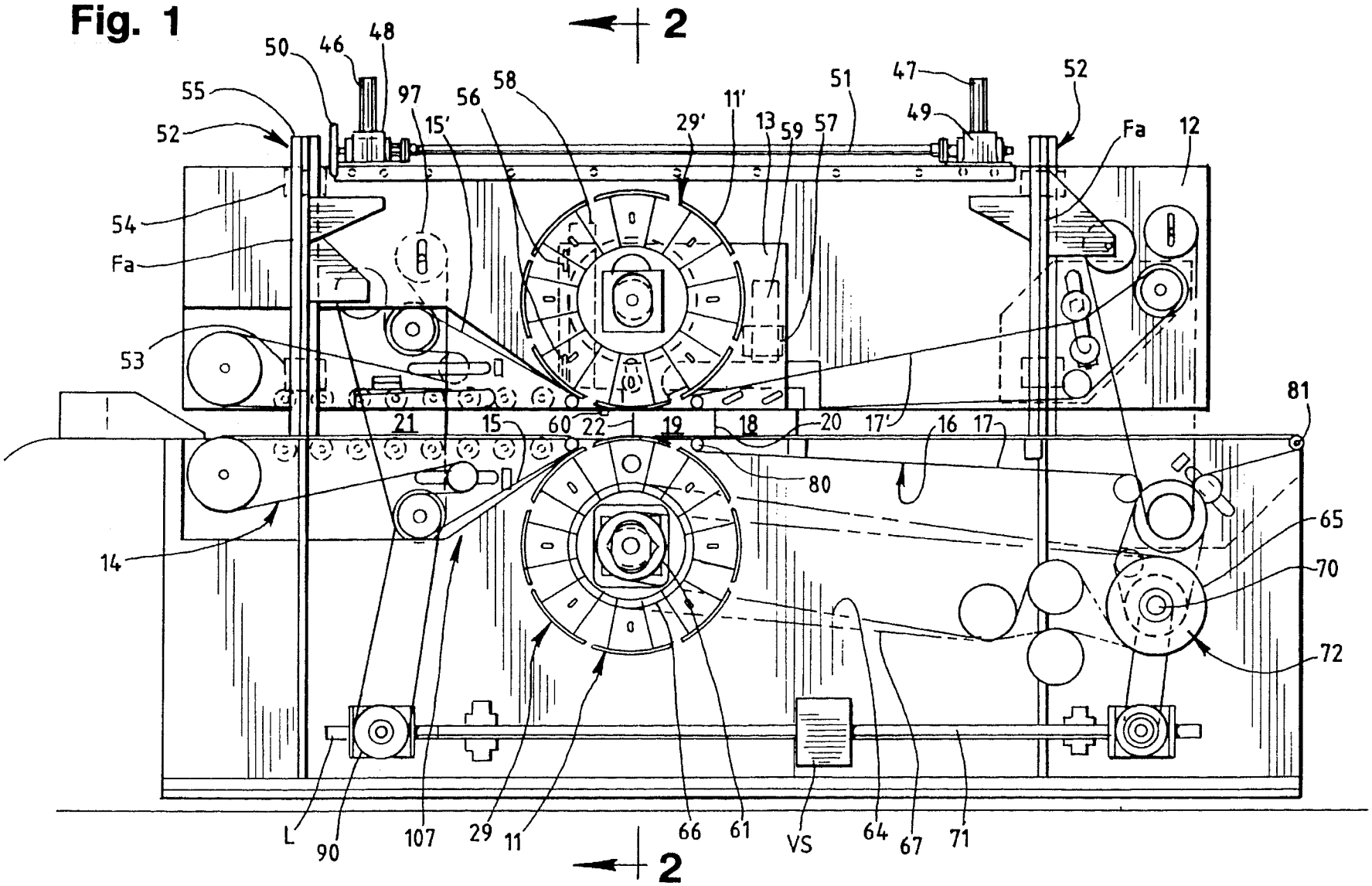
FIG. 1 is a fragmentary side elevational view, somewhat schematic, of the apparatus employed in the practice of the invention.
Figure 2:
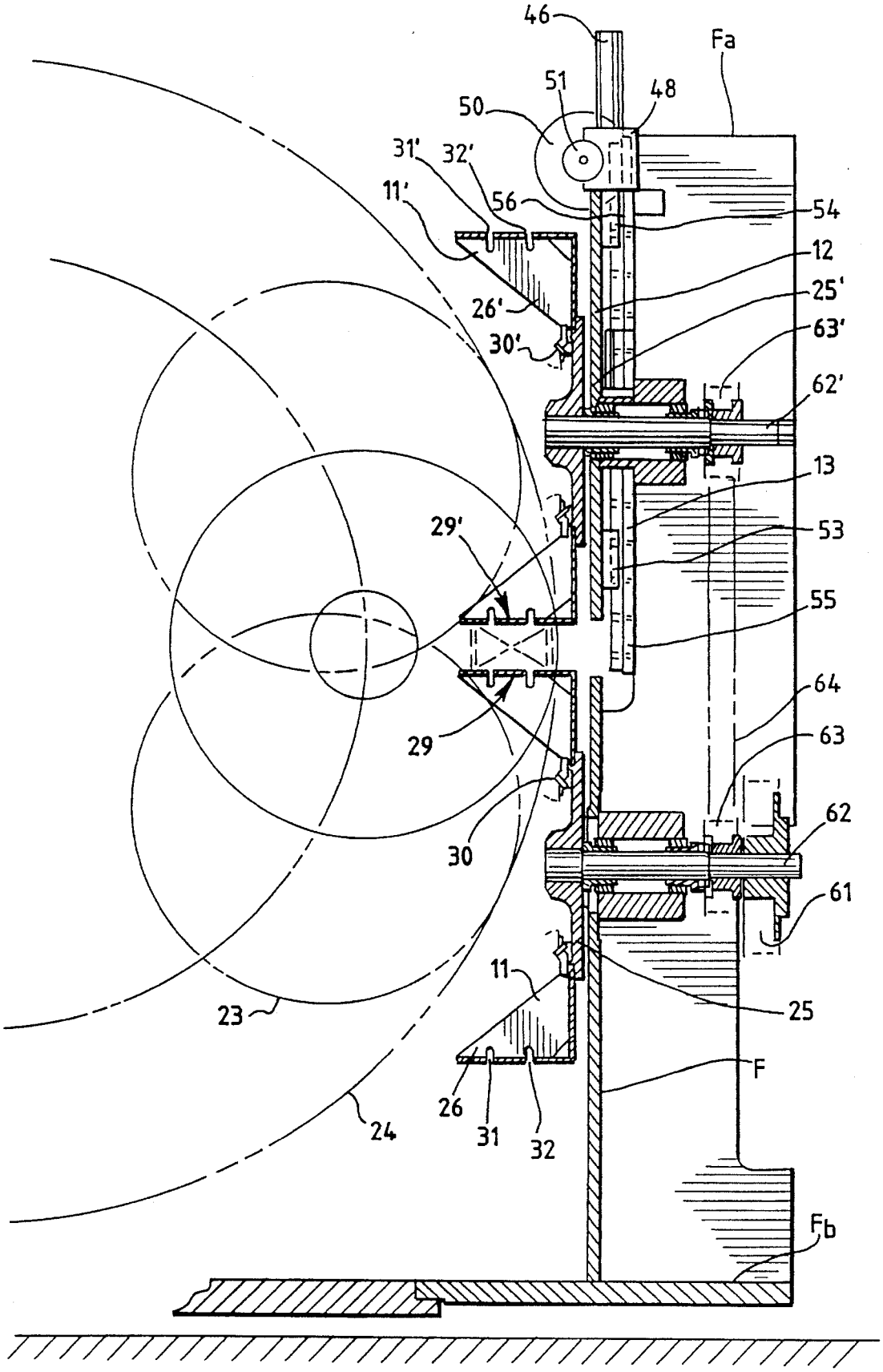
FIG. 2 is a fragmentary sectional view such as would be seen along the sight line 2—2 applied to FIG. 1.

With reference first to FIGS. 1 and 2, the symbol F designates generally a portion of the main frame which carries the lower drum 11. The frame F also positionably carries an upper frame 12 which in turn carries the upper drum 11'. More particularly, the upper frame 12 positionably carries a subframe 13 which, in turn carries the upper drum 11'—also seen in larger scale in FIGS. 6 and 7. Where an element in the upper portion is substantially similar or coacts with an element in the lower portion, the same reference numeral is used but supplemented by a prime (').

Figure 5:
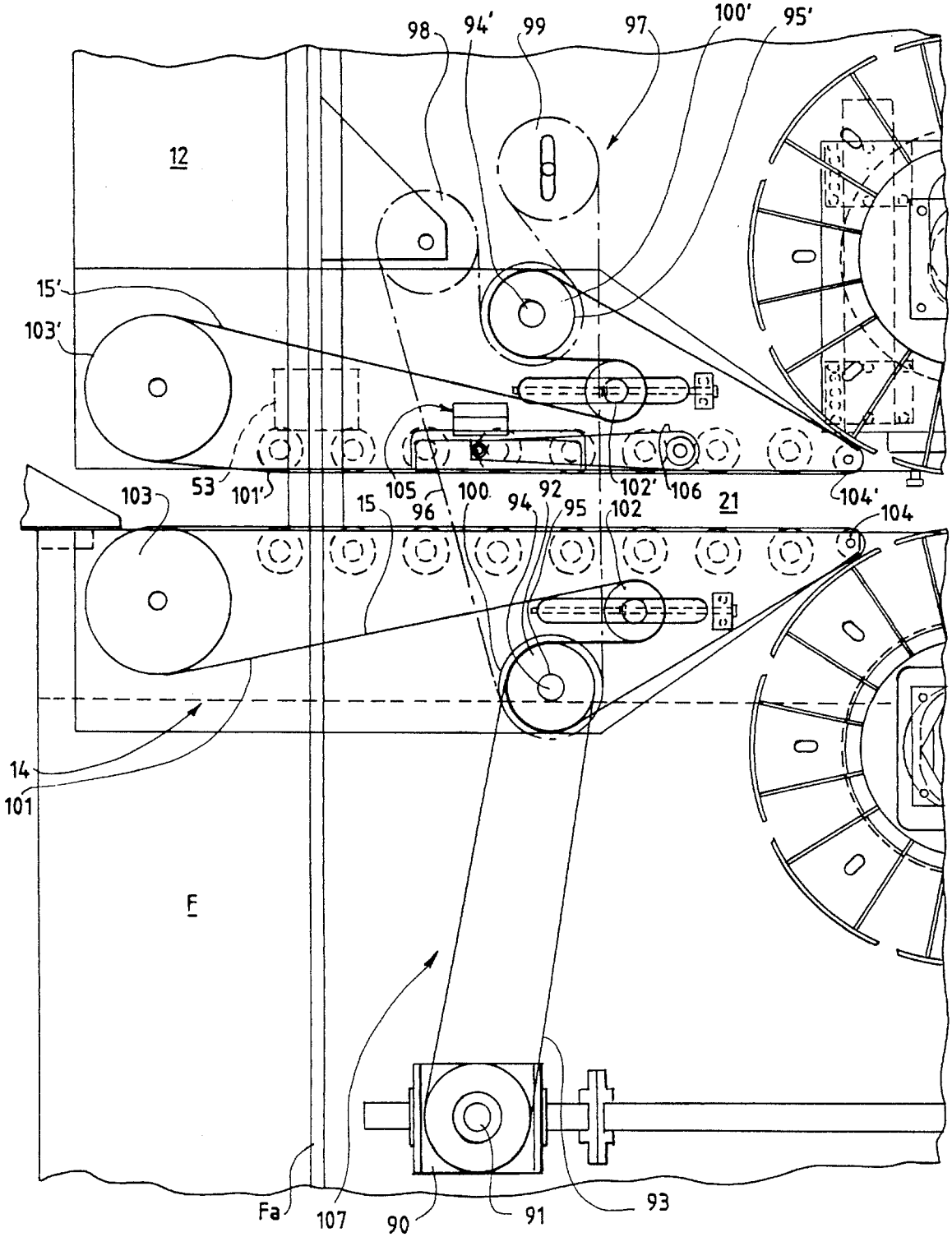
FIG. 5 is an enlargement of the left portion of FIG. 1.

The numeral 14 designates generally the infeed conveyor which is made up of the lower belt system 15 and upper belt system 15'—seen in larger scale in FIG. 5. The outfeed conveyor is generally designated 16 and is made up of the lower belt system 17 and the upper belt system 17'—see in larger scale in FIG. 8.

Advantageously all of the upper elements, i.e., the upper infeed belt system 15' the upper drum 11 and the outfeed belt system 17' are mounted on the upper frame 12 so as to be vertically movable to accommodate varying ribbon thicknesses. The movable mounting of the upper drum 11' permits it to be moved or floated independently of the upper belt systems 15', 17'. This provides the ability to set the compression levels at the time of cut separately from compression in the infeed belts. It further offers overload or jam protection for the drum 11'.

The numerals 18 and 19 (see the central portion of FIGS. 1 and 6) designate stacks of web product which may be either superposed plies or interfolded plies as in previously mentioned U.S. Pat. No. 4,052,048. The stacks 18, 19 are separated by a line of severance 20. The stack or product 19 is separated from the ribbon 21 by another line of severance 22. Each line of severance 20, 22 has been developed by an orbiting blade 23 which has an envelope 24 representing the cutting orbit—see FIG. 2.

A suitable saw for carrying the blades 23 can be seen in any one of U.S. Pat. No. 4,041,813 or the other cases mentioned above and reference to all those cases is made expressly herein to incorporate the disclosures thereof in this application.

Prior Art Saw

Referring now to FIGS. 3 and 4 the symbol F designates generally the frame of the machine which includes a pair of side frames.

The frame F provides a path P which extends linearly (horizontally) for the conveying of ribbon R and ultimately the severed product R'. The ribbon R and thereafter the product R' are conveyed along the path P by a suitable conveyor generally designated C. The symbol B designates generally the blade mechanism which optimally includes two disc blades D—see also FIG. 4. As can be seen from FIG. 4, there is provided a bracket for each blade as at B which support the usual grinders G.

The blades D and their associated structure are carried by a skew plate SP which supports the skew arm A for rotation about a skew axis S which is arranged at a minor acute angle θ to the path P (see the upper central portion of FIG. 4). Rotation for the skew arm A is provided by means M—see FIG. 4.

Drums

Each of the drums 11, 11' is cantilever mounted as can be appreciated from a consideration of FIG. 2 where the drum 11 is seen to include a spider 25 equipped with a plurality of radially-extending brackets 26. The upper drum 11' has an identical spider 25' and brackets 26'. Adjacent brackets carry spaced apart arcuate flanges 27, 27' defining slots 28, 28' therebetween—compare FIGS. 1 and 7.

Thus, rotation of the drums 11, 11' results in an orbiting of flanges 27 and therefore the slots 28, 28'. This defines a motion corresponding to the orbited periphery or cylindrical envelope generally designated 29, 29' in the central portions of FIG. 1 and also in FIG. 6.

As can be appreciated from a consideration of FIG. 2, the envelope 24 of the blade 23 intersects the envelopes 29, 29' of the drums 11, 11' respectively to provide the cuts 20, 22 by virtue of passing through aligned slots 28, 28'. The brackets 26, 26' are secured to their respective spiders 25, 25' by quick-disconnect clamps 30, 30'—see FIG. 2. A suitable clamp is Model No. TC-225-U available from Reid Tool located in Muskegon, Mich.

The drums 11, 11' are equipped with two grooves as at 31, 32 and 31', 32' (see the lower portion of FIG. 2) which extend around the periphery and intersect the slots 28. The grooves 31, 32, 31' and 32' allow the placement of stripper fingers 33, 33' relative to drums 11, 11' respectively (see the central portion of FIG. 7). This aids in feeding the cut end of the ribbon into the outfeed conveyor belt system 16.

Figure 9:
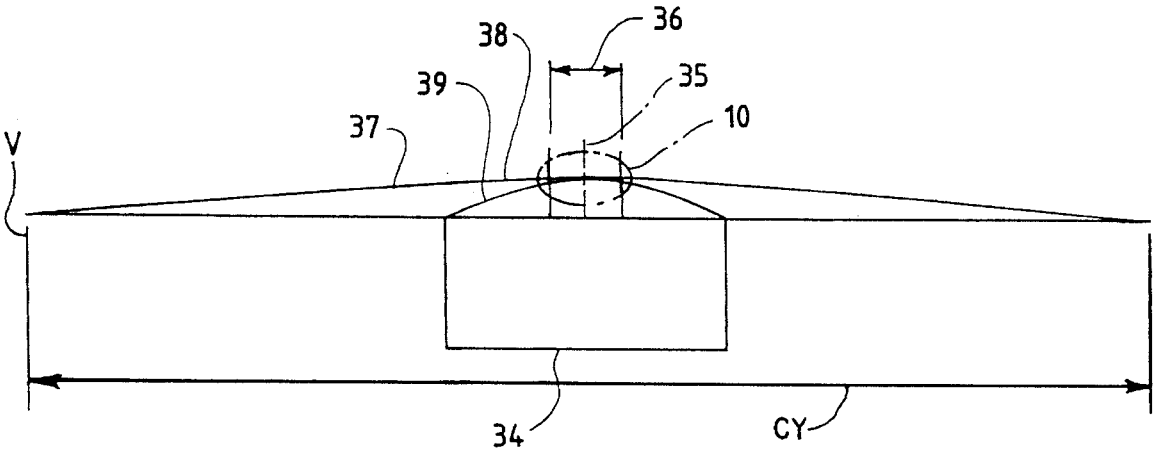
FIG. 9 is a chart showing a velocity profile as a function of cutoff cycles.
Figure 10:
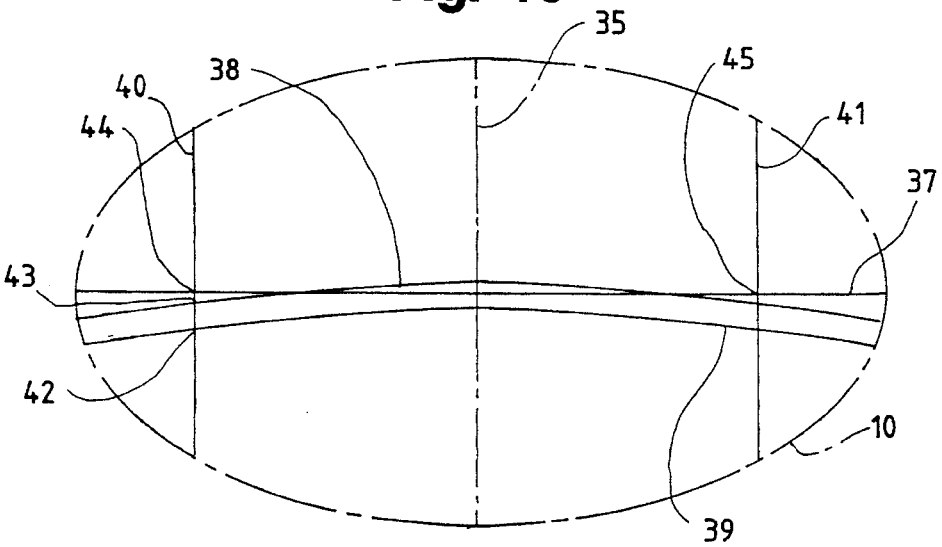
FIG. 10 is an enlargement of the encircled portion in the center of FIG. 9.

FIGS. 9 and 10 Charts

This action is depicted graphically in FIG. 9 where the ordinate is velocity and the abscissa represents blade cycles of cutoff, more particularly, the abscissa includes four cutting cycles which would correspond to a half revolution of a drum 11 or 11' with eight slots, and two revolutions of a double-bladed saw. The total length illustrated in FIG. 9 is four cycles as indicated by the dimension line at the bottom of FIG. 9.

One cutting cycle is designated by the numeral 34 in FIG. 9 and the vertical construction line designated 35 itself designates the middle of the cut. The numeral 36 designates the blade to drum slot engagement while the numeral 37 designates the horizontal velocity component of a drum slot based on the 8-time drum. The numeral 38 designates the saw blade velocity for nominal cutoff while the numeral 39 designates a saw blade velocity for a cutoff 38 mm. (1.50 inches) under nominal. The important relationships in FIG. 9 are enlarged in FIG. 10 where again the numeral 35 designates the middle of the cut while the numerals 40 and 41 represent respectively the start of the cut and the end of the cut. Again, the numerals 38 and 39 designate respectively the saw blade velocity for nominal cutoff and the saw blade velocity for cutoff 38 mm. (1.50 inches) under normal.

Still referring to FIG. 10, the other portions designated include 42 as representing the blade velocity at the start of the cut for minimum cut length while 43 designates the blade velocity at the start of cut for the nominal cut length. The numerals 44, 45 designate the slot velocity at the start and end of the cut for any cut length in the range available with a given geometry.

The diameter of the drum causes near constant velocity during the blade-slot engagement due to its large diameter. The motion is slightly greater than constant velocity because it curves down like the motion of the blade. Below the saw blade velocity 39, one-half of the blade-slot clearance is lost unless an extra slot is added at which time the drum speed is also decreased, bringing it closer to the blade speed.

Operation

The outfeed belt systems 17, 17' provide control for the front end of the newly formed stack during the cut and also control and convey it away for further handling. This belt system optimally is run at a speed equal to or exceeding the surface speed of the drums 11, 11'.

As pointed out previously, as the cutoff length decreases/increases and the forward velocity of the saw also decreases/increases but the drum speed remains the same (one slot per cut), the blade is no longer centered in the slot and when the acceptable slot to blade clearance is lost, the drum has to be exchanged to one having either one more or one fewer slots—assuming no change in drum diameter. This will then cause a change in the drum RPM reducing the forward speed mismatch.

Based on a saw blade making a 600 mm (24 inches) radius arc and a drum having roughly 300 mm. (12 inches) radius the initial blade-to-slot clearance is reduced in half after a cutoff adjustment of 38 mm (1.50 inches) below the nominal cut length of the drums. The same would be true if one went 38 mm. (1.50 inches) above the nominal, but as discussed before, the system will perform best if nominal cut length is not exceeded. An example of a suitable arrangement is a slot width of 25 mm (one inch) with a blade position variance width range up to about 13 mm. (0.50 inches) leaving a clearance (if the blade is centered as at nominal cutoff) of 6 mm. (0.25 inches) on each side. In order to cut a section 12.5 mm by 12.5 mm (5"×5"), it is advantageous to use a saw having a 610 mm (24") radius to the blade center—914 mm (36") to the envelope and a drum having a 610 mm (24") diameter. Normally, the speed of the conveyor is limited by the speed of the saw.

The main reason that the blade stays centered in the slot during a nominal cutoff is because the large diameter of the drum causes near constant velocity during the cutting phase. However, the motion is actually better than constant velocity because the slot accelerates horizontally prior to the cut and decelerates after—just like the blade. This is because both the slot and blade are simultaneously tracing sinusoidal arcs, although in different intersecting planes. The blade, as always on 2 blade saws, with respect to the ribbon, accelerates up to the point of mid-cut and then decelerates as it leaves the ribbon until it stops all forward velocity at one-half cycle after mid-cut. Any slot in the drum also accelerates with respect to the ribbon as it approaches contact with the ribbon and until mid-cut, at which time it decelerates due to its rotary travel. The difference being that one-half cycle after mid-cut, the slot is not stopped, but is continuing to decelerate. Because of practical size reasons the drum will generally have six to fourteen slots around while the saw has two blades.

The openings or slots in the drums are sized to provide the same degree of support to the bottom of the ribbon as with chain conveyors, with the bottom slot being more critical since it keeps the bottom plies from tearing—which was a problem previously. The upper drum can have more slot clearance since its main job is to provide ribbon feed and compression on the ribbon so as not to allow the cutting action to disturb the appearance of the ribbon.

Thickness and Compression Adjustment

As pointed out previously, the upper frame 12 may be raised or lowered to adjust to different ribbon thicknesses. This is effected in the illustration given by the provision of vertically elongated worm screw means 46, 47—see FIGS. 1 and 2. These are received in jack means 48, 49 fixed to the upper frame 12, and the screw means 46, 47 are fixed to the main frame F. For simplicity, the power means for the jack means 48, 49 is illustrated by hand wheel 50, with the jack means 48, 49 being coupled together by a shaft 51. For guiding the movement of the upper frame 12 during vertical movement, I provide slide and rail means generally designated 52—see the upper right and left portions of FIG. 1. The two means 52 are the same so only the left hand arrangement is described.

Rail 55 is mounted on a transversely-extending gusset portion $F_a$ of the main frame F. This can be better appreciated from a consideration of FIG. 2 where the main frame F is seen as a longitudinally extending plate-like member equipped with a transversely-extending gusset or flange $F_a$ which extends upwardly from the base plate $F_b$. This gusset extends up to the jack means 46 which it supports as well as the rail 55. Slides 53, 54 fixed to the upper frame 12 are slidably received by rail 55.

Mention was also previously made of the independent movability of the subframe 13 which carries the upper drum 11'. The subframe 13 is fixedly equipped with two upper vertically aligned slides 56 and a slide 57 longitudinally spaced therefrom (see FIG. 1) with the upper of the slides 56 also being designated in FIG. 2. The slides 56 slidably receive rail 58 while the slide 57 receives rail 59. The rails 58, 59 are fixed to the upper frame 12. Adjustment of the position of the subframe 13 is achieved by a stop screw 60 (see FIG. 6) threadably received in upper frame 12 and which determines how low the subframe can move under its own weight. The "floating" nature of the subframe 13 and thus the upper drum 11' provides jam protection.

Drum Drive

The lower drum 11 is equipped with an input pulley 61—see the lower right in FIG. 2. This is removably mounted on the shaft 62 which carries the spider 25. The shaft 62 also carries a drive pulley 63 which is coupled to driven pulley 63' carried by shaft 62' of the upper drum 11'. The coupling is by a cog belt 64 which insures that the drums 11, 11' are rotated in synchronism.

Now referring to FIG. 1, the numeral 61 again designates the input pulley for the drum 11. It receives power via belt 64 from drive pulley 65. This could be representative of the 13-time drum. However, when the drum 11 has a different number of slots, a different input pulley is employed—as at 66—and belt 67 which could correspond to a 8-time drum. Different tension pulleys as at 68 and 69 are used for the different belt arrangements 64, 67. The power to the pulley 65 is derived from a shaft 70 which is interconnected with the main line shaft L via line 71 and a variable speed drive VS—see the lower left hand portion of FIG. 1. This provides the drive generally designated 72 for the outfeed conveyor 16 which, along with the drive for the saw and the drums which provides a speed different from the drive speed of the infeed conveyor.

Drive for Outfeed Conveyor

Figure 8:
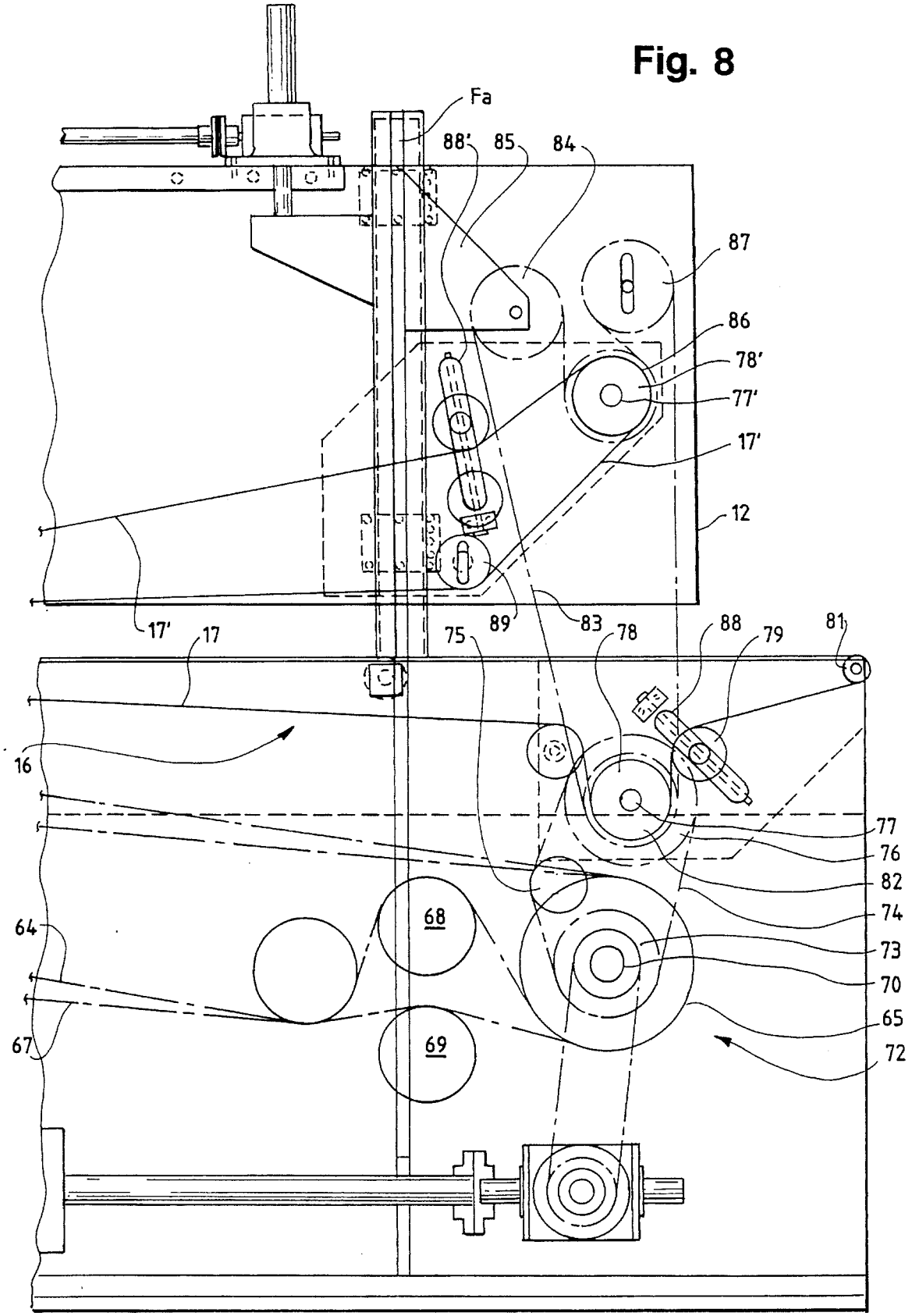
FIG. 8 is an enlargement of the right portion of FIG. 1.

The drive for the outfeed conveyor 16 also comes from the shaft 70 at the lower right in FIG. 1 and seen in larger scale in FIG. 8. For that purpose, the shaft 70 carries a pulley 73 which via belt 74 and tensioner pulley 75 drives pulley 76.

The pulley 76 is fixed on conveyor drive shaft or axle 77 which also carries drive roll 78 on which conveyor belt 17 is entrained. The belt 17 wraps about 180° of roll 78 as seen in the right center portion of FIG. 8 and passed around roll 79. The belt 17 has an upper run traveling downstream between head roll 80 and tail roll 81. All of the pulleys and belt rolls are carried by the frame F and the mounting details have been omitted for ease and clarity of presentation. One example of mounting of an element can be seen in FIG. 2 where the bearing for the shaft 62 carrying the lower drum 11 is secured to the frame F.

In similar fashion the various pulleys and belt rolls for the upper outfeed conveyor 17' are carried by the upper frame 12.

The drive for the upper outfeed conveyor 17' includes a drive pulley 82 on which belt 83 is entrained. The pulley 82 is coaxial with the head roll 78 on axle 77. As seen in the right hand portion of FIG. 8, the belt 83 in traveling upwardly away from pulley 82 is entrained on pulley 84. Pulley 84 is rotatably mounted on a flange 85 fixed to the main frame gusset $F_a$. The belt 83 is then wrapped about pulley 86 which is coaxial with the head roll 78' for the upper conveyor belt 17'. This roll is carried by axle 77' supported on upper frame 12. The belt 83 then is entrained about pulley 87 also mounted on upper frame 12—before traveling back to drive pulley 82. The three pulley cluster 84, 86 and 87 insures that the belt travel remains constant irrespective of the position of the positionable upper frame 12. In other words, the belt distance in traveling from pulley 84 to pulley 82 remains constant. The pulley 87 is slotted to provide a means for initially tensioning belt 83.

The belts 17, 17' are suitably tensioned by mechanisms 88, 88' provided respectively on the main frame F and the upper frame 12. Of advantage is the arrangement of the divergent nature—in proceeding downstream—of the belts 17, 17'. This relieves the compression on the products 18, 19, etc. which was provided by the drums 11, 11'. As illustrated, the lower run of the upper belt 17' has a slight upward inclination developed by the roll 89.

Drive for Infeed Conveyor

Referring to FIGS. 1 and 5, the numeral 90 in the lower left hand portion represents a gear box which is connected to the line shaft L. Now referring to FIG. 5, the output of the gear box 90 is provided by a pulley 91 which is coupled to a drive pulley 92 by belt 93. The pulley 92 is mounted on a shaft 94 which also carries a pulley 95 coaxially with the pulley 92. The pulley 95 in turn entrains a belt 96 which travels around a three-pulley cluster generally designated 97 for accommodating vertical movement of the upper frame 12 without changing the length of belt travel. Thus, as was the case with the outfeed conveyor cluster of pulleys 84, 86 and 87, the cluster 97 provides a pulley 98 fixed to the main frame $F_a$ and pulleys 99 and 95' mounted on the vertically movable upper frame 12. The pulley 95' is mounted on a shaft 94' which also carries a drive roll 100' coaxially with the pulley 95'. The belt 101' of the upper infeed conveyor 15' wraps the roll 100', proceeds through a tensioning device 102', then around tail roll 103' and eventually around nose roll 104'.

The lower infeed belt system 15 features a similar belt 101 which has an upper run proceeding from tail roll 103 to nose roll 104, then around roll 100 which also is mounted on shaft 94 then through tensioning device 102 and finally back to the tail roll 103.

Compression Control

Referring still to FIG. 5, the numeral 105 designates generally a load cell which develops a constant compression on the ribbon 21. A suitable device is a Model 41 available from Sensotec,located in Columbus, Ohio. The load cell 105 is mounted on upper frame 12 and is coupled to arm 106 which is pivotally mounted on the upper frame 12 and which carries three of the rollers bearing against the lower run of the upper infeed belt 101'—still referring to the central portion of FIG. 5. When a change in the thickness is sensed by the load cell 105, a suitable signal is sent to the controller PLC of FIG. 3 which actuates means for raising or lowering the subframe 12. This can be a stepper motor as previously mentioned and a suitable motor is Model SS700, available from Superior Electric located at Bristol, Conn. The use of load cell feedback stabilizes the amount of ribbon fed each cycle because constant ribbon compression is maintained as ribbon density changes.

Overall control of the operation is provided by a programmable logic controller of the type normally associated with continuous motion saws. A suitable controller is the Series 5 PLC of Allen-Bradley located in Milwaukee, Wis. As indicated above, the PLC is shown in FIG. 3 as part of the prior art but in addition to governing the operation of the saw also is used herein for controlling the operation of the variable speed drive VS which thus controls also the outfeed conveyor drive generally designated 72 and the speed of drums 11, 11'. The PLC can also control the line shaft L and with it the advance of the ribbon 21 from the unwinds (not shown) to the infeed drive system generally designated 107—see FIG. 1.

An additional control or function is included and for this, reference is made to FIG. 6. There it will be noted that each bracket 26, 26' is equipped with an opening 108 or 108'. These are employed when a replacement drum is installed. Because it is not known just where the spider 25, 25' stops, I have found it convenient to place a number of alignment slots 108, 108' around each drum. An alignment hole is provided in the main frame F and the upper frame 12 so that a rod can be conveniently inserted through the frame holes (not shown) and the alignment openings 108, 108'.

Summary of Operation

The inventive method of cutting an elongated, multi-ply flat-surfaced ribbon of web material 21 (see the central part of FIG. 1) includes the steps of advancing the ribbon along a linear path P, rotating a pair of cantilever-mounted drums 11, 11' on opposite sides of the path to flank ribbon upper and lower flat surfaces, the drums having a plurality of axially-extending slots 28, 28' in the orbiting periphery thereof, orbiting a saw blade 23 adjacent the path, and cyclically intersecting the blade orbit 24 with the slot orbits or envelopes 29, 29' to transversely cut the ribbon as at 22 into a series of products 18, 19 while advancing the saw blade parallel to the path.

Correspondingly, the inventive apparatus for cutting an elongated, multi-ply, ribbon having flat top and bottom surfaces includes a main frame F defining the linear path P. There are means 14 on the frame for advancing the ribbon 21 along the linear path. Thereafter, provided in the path are a pair of cantilever-mounted drums 11, 11' mounted on the frame on opposite sides of the path to flank the ribbon flat surfaces. The identical drums each have a plurality of axially-extending slots 28, 28' in the periphery 29 thereof. Means as at 61–70 are operably associated with the frame for rotating the drums so as to orbit the slots as at 29, 29'. A saw blade 23 is mounted on the frame adjacent the path and means as at M in FIG. 4 are operably associated with the frame for orbiting the blade at 24. The drum and blade orbits 29, 29', 24 cyclically intersect at the path P to transversely cut 20, 22 the ribbon into a series of products 18, 19 while advancing the blade parallel to the path.

The drums 11, 11' are rotated by drive means 61 at a surface speed at or greater than the speed of advance of the ribbon 21. When a change in the length of the product 18, 19 is desired, the ribbon speed relative to drum speed is changed. For example, when 500 products per minute are desired but the length is to be increased, the main drive L is sped up so that more ribbon is sped past the saw. Then, however, the vari-speed control VS will slow the speed of advance of the saw 23 to retain the 500 cuts/minute. Then, if a square cut is desired, the skew angle has to be changed.

In the illustration given—with a 38 mm. (1.50 inch) range—if it is desired to go beyond that range in changing product length, then the drums 11, 11' have to be changed. Usually, this involves replacing the drums with those having a different number of slots. An alternative is to provide drums having a different diameter and slot circumferential dimension.

Optimum operating conditions include orienting the saw blade skew to provide a velocity component parallel to the path which has a sinusoidal profile and orienting the drums to provide a velocity component parallel to the path also having a sinusoidal component and with the maxima of both sinusoidal profiles being generally coincident whereby the orbit intersections are generally midway of the circumferential length of each slot.

The preferred form of the invention includes providing infeed and outfeed conveyor means 14, 16 in the path P on the upstream and downstream sides of the path, the conveyor means each having upper and lower belt runs 15, 17, 15', 17' and mounting the upper runs 15', 17' and the upper drum 11' therebetween for movement toward and away from the ribbon 21 to accommodate ribbons of different dimensions between the flat surfaces thereof and/or to provide different ribbon compressions.

The preferred form further includes providing a mounting 13 for the upper drum 11' for movement independent of the conveyor means upper runs 15', 17' to set compression loads separate from that of the infeed conveyor means 14. In the illustration given, the upper frame 12 positionably carries a subframe 13 which, in turn, carries the upper drum 11'. The shaft 62' for the spider 25' extends through the frame 12 (see FIG. 2) so, to accommodate this movement, the frame 12 is equipped with an obround opening 109—see the upper part of FIG. 6.

The invention further includes providing ribbon dimension or compression sensing and signalling means 105 operably associated with the infeed conveyor means 14, and moving all upper conveyor means 15', 11', 17' via frame 12 in response to a signal from the sensing and signalling means 105.

While in the foregoing specification a detailed description of an embodiment of the invention has been set down for the purpose of illustration, many variations in the details hereingiven may be made by those skilled in the art without departing from the spirit and scope of the invention.

I claim:

1. A method of cutting an elongated, multi-ply, flat-surfaced ribbon of web material comprising the steps of:

advancing said ribbon along a linear path at a speed of advance, rotating a pair of cantilever-mounted drums on opposite sides of said path to flank said ribbon flat surfaces, each of said drums having a periphery and a plurality of axially-extending slots in the periphery thereof, said slots when said drums are rotated defining slot orbits, orbiting a saw blade adjacent said path, and cyclically intersecting the blade orbit with the slot orbits to transversely cut said ribbon into a series of products while advancing said saw blade parallel to said path.

2. The method of claim 1 in which said method includes rotating said drums at a surface speed at or greater than said speed of advance of said ribbon.

3. The method of claim 1 in which said method includes changing at least said speed of advance of said ribbon to provide a change in product length.

4. The method of claim 3 in which said method includes providing said saw blade with a speed of advance and changing the speed of advance of said saw blade during cutting.

5. The method of claim 1 in which method includes (a) changing the speed of advance of said ribbon, (b) providing said saw blade with a speed of advance, (c) changing the speed of advance of said saw blade during cutting, and (d) replacing said drums to provide a change in product length.

6. The method of claim 5 in which said replacing step includes providing first drums with a first number of slots and thereafter replacing said first drums with said second drums having a different number of slots.

7. The method of claim 5 in which said step of first drum replacing includes replacing said first drums with said second drums having a different diameter and slot circumferential dimension.

8. The method of claim 5 in which said method includes providing said drums with a surface speed and changing the drum surface speed as well as changing the drums.

9. The method of claim 1 in which method includes orbiting said saw blade at a skew angle.

10. The method of claim 9 in which method includes changing (a) the speed of advance of said ribbon, and (b) the skew angle of said saw blade to provide a change in product length.

11. The method of claim 10 in which said method includes providing said drum slots of a predetermined circumferential dimension and, when the change in skew angle still provides a predetermined blade to slot clearance, retaining the drums in position but when the change in skew angle provides less than said predetermined blade to slot clearance, replacing the drums.

12. The method of claim 1 in which said method includes orienting said saw blade skew to provide a velocity component parallel to said path having a sinusoidal profile and orienting said drums to provide a velocity component parallel to said path also having a sinusoidal component and with the maxima of both profiles being generally coincident whereby the orbit cyclic intersectings are generally midway of the circumferential length of each slot.

13. The method of claim 1 in which said method includes providing infeed and outfeed conveyor means in said path on the upstream and downstream sides of said path, said conveyor means each having upper and lower belt runs, and mounting said upper runs and the upper drum for movement toward and away from said ribbon to accommodate ribbons of different dimensions between said flat surfaces and/or to provide different ribbon compressions.

14. The method of claim 13 in which said method includes providing a mounting for said upper drum for movement independent of said conveyor means upper runs to set compression loans separate from that of said infeed conveyor means.

15. The method of claim 13 in which said method includes providing a ribbon dimension sensing and signalling means operably associated with said infeed conveyor means, and moving said infeed conveyor upper run in response to a signal from said sensing and signalling means.

16. The method of claim 13 in which said method includes providing a ribbon compression sensing and signalling means operably associated with said infeed conveyor means, and moving said infeed conveyor upper run in response to a signal from said sensing and signalling means.

17. Apparatus for cutting an elongated, multi-ply, flat-surfaced ribbon of web material comprising a frame defining a linear path, means on said frame for advancing said ribbon along said linear path, a pair of cantilever-mounted drums mounted on said frame on opposite sides of said path to flank said ribbon flat surfaces and having axes of rotation, each of said drums also having a periphery and a plurality of axially-extending slots in said periphery, means operably associated with said frame for rotating said drums so as to move said slots through orbits, a saw blade mounted on said frame adjacent said path, and means operably associated with said frame for orbiting said blade, said drum and blade orbits cyclically intersecting at said path to transversely cut said ribbon into a series of products while advancing said blade parallel to said path.

18. The apparatus of claim 17 in which said apparatus includes means for changing the rotational speed of said drums.

19. The apparatus of claim 17 in which said apparatus includes means for changing the speed of advance of said ribbon.

20. The apparatus of claim 19 in which said apparatus also includes means for changing the speed of advance of said saw blade.

21. The apparatus of claim 17 in which said drums are equipped with means for removably mounting the same on said frame.

22. The apparatus of claim 17 in which means are mounted on said drum for advancing cut product away from said saw blade, said product advancing means including upper and lower belt systems having runs contacting said products, said runs diverging in the direction of ribbon advance to relieve the compression in said products provided by said drums.

* * * * *